US009073717B2

(12) United States Patent
Li et al.

(10) Patent No.: US 9,073,717 B2
(45) Date of Patent: Jul. 7, 2015

(54) CORELESS PAPER ROLL REWINDING MACHINE WITHOUT A WINDING ASSISTING PLATE

(75) Inventors: Qibiao Li, Nanhai Foshan (CN); Zhaobo Luo, Nanhai Foshan (CN)

(73) Assignee: Foshan Baosuo Paper Machinery Manufacture Co, Ltd., Nanhai Foshan (CN)

( * ) Notice: Subject to any disclaimer, the term of this patent is extended or adjusted under 35 U.S.C. 154(b) by 266 days.

(21) Appl. No.: 13/640,473

(22) PCT Filed: Feb. 25, 2011

(86) PCT No.: PCT/CN2011/000314

§ 371 (c)(1), (2), (4) Date: Oct. 10, 2012

(87) PCT Pub. No.: WO2011/124086

PCT Pub. Date: Oct. 13, 2011

(65) Prior Publication Data

US 2013/0026280 A1 Jan. 31, 2013

(30) Foreign Application Priority Data

Apr. 10, 2010 (CN) ..... 2010 1 0149795

(51) Int. Cl.
*B65H 18/14* (2006.01)
*B65H 18/26* (2006.01)
(Continued)

(52) U.S. Cl.
CPC ..... *B65H 27/00* (2013.01); *B65H 19/2276* (2013.01); *B65H 19/28* (2013.01); *B65H 2406/331* (2013.01); *B65H 2301/41426* (2013.01); *B65H 2406/3612* (2013.01)

(58) Field of Classification Search
USPC ..... 242/541, 541.2, 535.1, 615.11, 615.12, 242/532.2, 332.3
See application file for complete search history.

(56) References Cited

U.S. PATENT DOCUMENTS 2,274,641 A * 3/1942 Abbott et al. ..... 162/371
3,037,557 A * 6/1962 Faeber et al. ..... 162/370

(Continued)

*Primary Examiner* — Emmanuel M Marcelo
*Assistant Examiner* — Michael Gallion
(74) *Attorney, Agent, or Firm* — Marshall A. Lerner; Bradford E. Mattes; Kleinberg & Lerner, LLP

(57) ABSTRACT

A coreless paper roll rewinding machine without a winding assisting plate comprises a rewinding upper roller (1) and a rewinding lower roller (2) that are parallel with each other. Paper (3) is wound on the rewinding upper roller (1) and passes through a roller gap between the rewinding upper roller (1) and the rewinding lower roller (2). A plurality of airflow channels (4) are formed in a roller body of the rewinding lower roller (2), and each of the air flow channels (4) is interconnected with a set of air suction holes (5) on the surface of the roller body. An air suction cover (6) provided with an exhaust opening is arranged close to the end of the rewinding roller (2). When one set of air suction holes (5) on the surface of the rewinding lower roller (2) is close to the roller gap, one of the air flow channels (4) interconnected with the set of air suction holes is rotated to a region interconnected with the exhaust opening of the air suction cover (6). When the set of air suction holes (5) on the surface of the rewinding lower roller (2) is far away from the roller gap, the corresponding air flow channel (4) is rotated to a region where it deviates from the exhaust opening. This coreless paper roll rewinding machine has high winding reliability, stable rewinding function and uniform roll compactness, and can prevent the indentation on the surface of the paper roll.

2 Claims, 3 Drawing Sheets

(51) Int. Cl.

| | |
|---|---|
| ***B65H 27/00*** | (2006.01) |
| ***B65H 19/22*** | (2006.01) |
| ***B65H 19/28*** | (2006.01) |

(56) References Cited

U.S. PATENT DOCUMENTS

| | | | | | |
|---|---|---|---|---|---|
| 3,122,295 | A | * | 2/1964 | Davison et al. | 226/50 |
| 3,991,538 | A | * | 11/1976 | Finn et al. | 53/419 |
| 4,165,132 | A | * | 8/1979 | Hassan et al. | 406/10 |
| 4,207,998 | A | * | 6/1980 | Schmid | 226/95 |
| 4,366,025 | A | * | 12/1982 | Gordon et al. | 162/358.1 |
| 4,529,141 | A | * | 7/1985 | McClenathan | 242/527.1 |
| 4,678,176 | A | * | 7/1987 | Roller | 271/94 |
| 4,705,199 | A | * | 11/1987 | Herman et al. | 226/95 |
| 4,892,263 | A | * | 1/1990 | Beisswanger | 242/552 |
| 4,998,658 | A | * | 3/1991 | Distefano et al. | 226/95 |
| 5,027,462 | A | * | 7/1991 | Kunzig et al. | 15/1.51 |
| 5,186,451 | A | * | 2/1993 | Hirao | 271/196 |
| 5,230,456 | A | * | 7/1993 | Germann et al. | 226/95 |
| 5,232,141 | A | * | 8/1993 | Mittmeyer et al. | 226/95 |
| 5,358,163 | A | * | 10/1994 | Naka | 226/95 |
| 6,745,976 | B1 | * | 6/2004 | Marion | 242/615.4 |
| 7,510,179 | B2 | * | 3/2009 | Kim | 271/121 |
| 8,028,988 | B2 | * | 10/2011 | Shakespeare et al. | 271/109 |
| 8,123,222 | B2 | * | 2/2012 | Ong | 271/276 |
| 8,302,900 | B2 | * | 11/2012 | Gambini | 242/542 |
| 8,535,780 | B2 | * | 9/2013 | Wojcik et al. | 428/153 |
| 2004/0159999 | A1 | * | 8/2004 | Dematteis | 271/264 |

* cited by examiner

CORELESS PAPER ROLL REWINDING MACHINE WITHOUT A WINDING ASSISTING PLATE

TECHNICAL FIELD

The present application relates to a rewinding machine, in particular to a rewinding machine which can produce a coreless paper roll.

BACKGROUND ART

A feature of the coreless paper roll is that there is no core in the middle of the paper roll. A conventional rewinding machine utilizes a winding assisting plate to complete the start of the winding process during rewinding of such a paper roll. For example, according to a patent with Chinese patent NO. 94101338.3 and entitled "Improved rewinding machine for coreless winding of a log of web material with surface for supporting the log in the process of winding", at the starting stage of rewinding, the disclosed rewinding machine makes a rewinding upper roller and a rewinding lower roller (called "winding rollers 1 and 3" in the patent) closed up temporarily, and depends on the support of a winding assisting plate (called "supporting surface 21" in the patent) to achieve the start of winding. After the start of winding, the rewinding upper roller and rewinding lower roller need to return to the normal position, so that the rewinding machine can continue rewinding. Such rewinding machine which depends on the winding assisting plate to perform the start of winding has the following defects:

1. the roller gap between the rewinding upper roller and rewinding lower roller has to be changed during the process from the start of winding to the rewinding, which causes the force applied on the paper roll to be not stable at the preliminary stage of rewinding, and thus easily causes failure of rewinding;

2. the winding assisting plate is used to support the paper roll at the preliminary stage of rewinding, which easily causes the force applied on the paper roll to be uneven. Thus, easily causes the tightness of the paper forming the core portion of the paper roll to be extremely uneven (known as "core portion wrinkling"), which seriously affects the subsequent process and the quality of finished products.

3. the rewinding lower roller moves while rotating at high speed, and the distance of movement must be precisely controlled, which certainly increase the structural complexity and manufacturing cost of the rewinding machine.

4. the front end of the winding assisting plate needs to be formed into comb shape and the tooth end of the comb is inserted into a ring groove which is provided on the cylindrical surface of the rewinding lower roller, and the ring groove provided on the cylindrical surface of the rewinding lower roller will leave significant indentations on the surface of the paper roll, which seriously affects the appearance of the paper roll.

SUMMARY

The object of present application is to provide a coreless paper roll rewinding machine without using the winding assisting plate.

The invention is achieved by the following: the coreless paper roll rewinding machine without the winding assisting place, comprises a rewinding upper roller and a rewinding lower roller which are parallel to each other, the paper is wound on the rewinding upper roller and passes through the roller gap between the rewinding upper roller and the rewinding lower roller, In particular, the roller gap between the rewinding upper roller and the rewinding lower roller is no more than 10 mm; a plurality of air flow channels are arranged in the roller body of the rewinding lower roller, the plurality of air flow channels are arranged spaced apart along the circumference of the roller body; each air flow channel is interconnected with a set of air suction holes provided on the surface of the rewinding lower roll; a set of air suction holes interconnected with the same air flow channel are arranged in one or more rows on the surface of the roller body; each row of air suction holes is arranged along the latitude direction of the roller body; respective rows of air suction holes are arranged spaced apart along the circumference of the roller body; an air suction cover is arranged in a position close to the end portion of the rewinding lower roller; as the rewinding lower roller rotates, when a certain row of the air suction holes on the surface of the rewinding lower roller is gradually closing toward the roller gap between the rewinding upper roller and the rewinding lower roller; the air flow channel in the roller body, which is interconnected with the row of air suction holes, is rotated to a region where it interconnects with the exhaust opening of the air suction cover; when a certain row of the air suction holes on the surface of the rewinding lower roller are gradually rotating away from the roller gap between the rewinding upper roller and the rewinding lower roller, the air flow channel in the roller body, which is interconnected with the row of air suction holes, is rotated to a region where it deviates from the exhaust opening of the air suction cover.

The invention's principle of starting the winding is as the following. When the air suction holes on the surface of the rewinding lower roller is gradually closing toward the roller gap between the rewinding upper roller and the rewinding lower roller, they will create a suction force, which rolls up the head portion of the paper; and the head portion of the paper is blocked by the narrow roller gap between the rewinding upper roller and the rewinding lower roller, so that the subsequently fed paper can continue to be rolled with the rolled-up paper, and thus the start of winding is performed.

The rewinding machine according to the present invention neither needs to depend on the support of the winding assisting plate, nor needs to change the roller gap between the rewinding upper roller and the rewinding lower roller during the whole process from the start of winding to end completion of rewinding. Therefore, the present invention has the following advantages:

1. During the rewinding, the force applied on the paper roll is even and stable, therefore, the reliability is high;

2. The tightness of the paper forming the paper roll core portion is even, therefore, the "core portion wrinkling" can be avoided;

3. The mechanism for moving the rewinding lower roller while it is rotating at high speed is not required, therefore, the invention is conducive to reduce structural complexity and manufacturing costs;

4. The ring groove on the cylindrical surface of the rewinding lower roller is not required, therefore, there will not be any indentation on the surface of paper roll; the appearance of the paper roll is improved.

DETAILED DESCRIPTION

Figure 1:
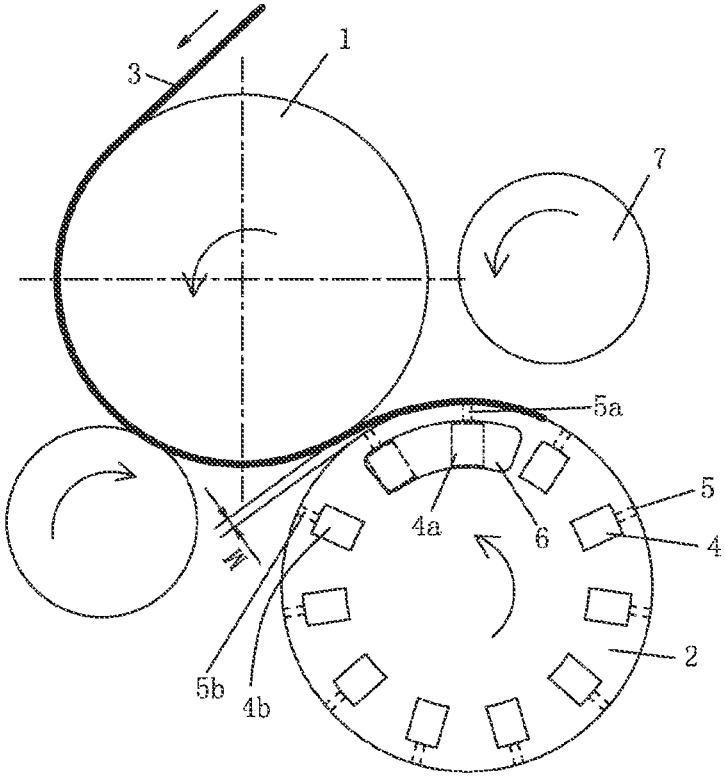
FIG. 1 illustrates a structure of the rewinding machine according to one embodiment of the present application.

As shown in FIG. 1, the coreless paper roll rewinding machine disclosed in the present invention comprises a rewinding upper roller 1 and a rewinding lower roller 2 which are parallel to each other. Paper 3 is wound on the rewinding upper roller and passes through the roller gap between the rewinding upper roller 1 and the rewinding lower roller 2. The roller gap M between the rewinding upper roller 1 and the rewinding lower roller 2 is no more than 10 mm. A plurality of air flow channels 4, which are parallel to the axis of the roller body, are distributed in the roller body of the rewinding lower roller 2, and each air flow channel goes through to an end surface of the roller body. A plurality of air flow channels 4 are arranged spaced apart along the circumference of the roller body. Each air flow channel 4 is interconnected with a set of air suction holes 5 on the surface of the roller body.

Figure 2:
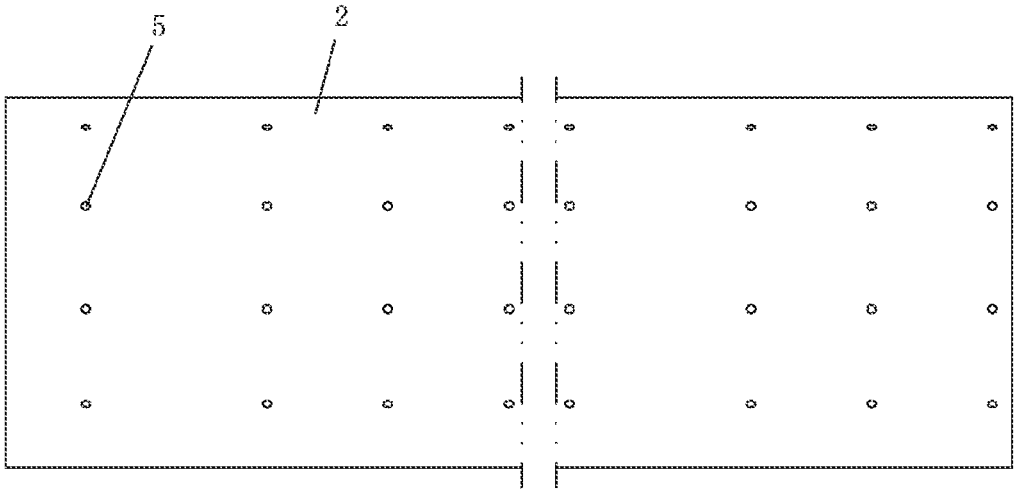
FIG. 2 illustrates a left side view of the rewinding lower roller shown in FIG. 1.
Figure 3:
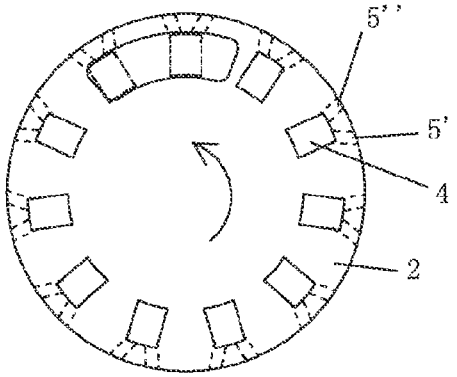
FIG. 3 illustrates another arrangement of the air flow channels in the roller body of the rewinding lower roller and the air suction holes on the surface of the roller body.
Figure 4:
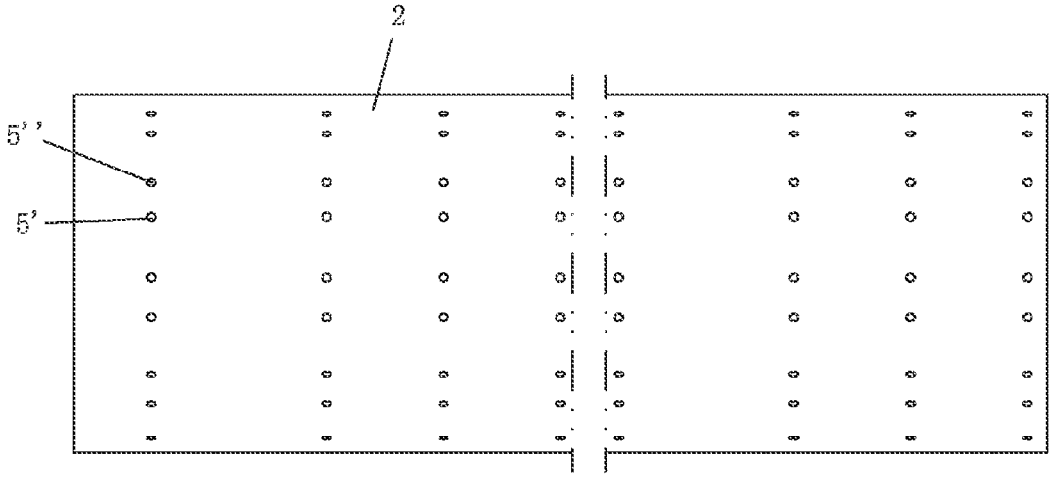
FIG. 4 illustrates a left side view of FIG. 3.

With reference to FIG. 1 and FIG. 2, the set of air suction holes 5 which is interconnected with the same air flow channel 4, is arranged to a row on the roller body. Or the set of air suction holes which interconnects with the same air flow channel 4, is arranged in two rows 5' and 5", as FIG. 3 and FIG. 4 shown. A priori, a set of air suction holes which is interconnected with the same air flow channel 4 also can be arranged in more rows. As shown in FIG. 2, each row of air suction holes 5 are arranged along the latitude direction of the roller body 2, however, it is not required that the direction of arrangement must be parallel to the axis of the roller body; it can have a certain helix angle. As shown in FIG. 1, respective rows of air suction holes 5 are arranged spaced apart along the circumference of the roller body. An air suction cover 6 is mounted in a position close to the end portion of the rewinding lower roller 2. The air suction cover 6 is connected to a vacuum pumping device (not shown) to produce a negative pressure. The exhaust opening of the air suction cover 6 faces towards the end surface of the rewinding lower roller 2. As the rewinding lower roller 2 rotates, when a certain row of air suction holes on the surface of the rewinding lower roller 2, such as the row of air suction holes 5*a* shown in FIG. 1, is gradually closing toward the roller gap between the rewinding upper roller 1 and the rewinding lower roller 2, the air flow channel 4*a* in the roller body which is interconnected with the row of air suction holes 5*a*, is rotated to a region where it interconnects with the exhaust opening of the air suction cover 6, which causes the whole row of air suction holes 5*a* to produce a suction force. When a certain row of air suction holes on the surface of the rewinding lower roller 2, such as a row of air suction holes 5*b* shown in FIG. 1, gradually rotates away from the roller gap between the rewinding upper roller 1 and the rewinding lower roller 2, the air flow channel 4*b* in the roller body which is interconnected with the row of air suction holes 5*b*, is rotated to a region where it deviates from the exhaust opening of the air suction cover 6, so that the whole row of air suction holes 5*b* loses the suction force. In this way, as the rewinding lower roller 2 rotates, each air flow channels 4 is periodically interconnected or disconnected with the exhaust opening of the air suction cover 6.

The air flow channels 4 shown in FIG. 1 can be interconnected with either both two end surfaces of the rewinding lower roller 2, or only one end surface of the rewinding lower roller 2. Correspondingly, the air suction cover 6 can be arranged either on both two ends of the rewinding lower roller 2 or only one end of the rewinding lower roller 2.

Figure 5:
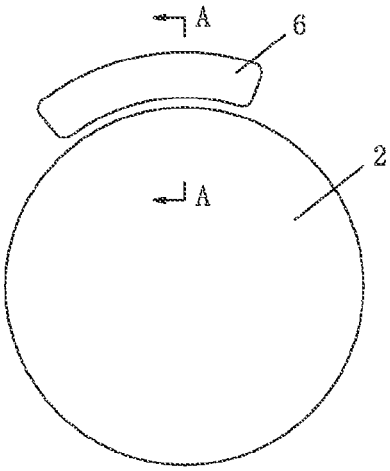
FIG. 5 illustrates another placement of the air suction cover.
Figure 6:
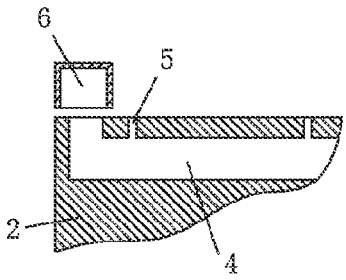
FIG. 6 illustrates partial section view along line A-A of FIG. 1.

The air suction cover 6 also can be arranged in a position close to the cylindrical surface of the rewinding lower roller 2 and close to the end portion of the roller body, as shown in FIG. 5 and FIG. 6. The exhaust opening of the air suction cover 6 faces towards the cylindrical surface of roller body. Correspondingly, the air flow channels 4 in the roller body is interconnected with the air suction cover 6 on the cylindrical surface of roller body, as shown in FIG. 6.

Figure 7:
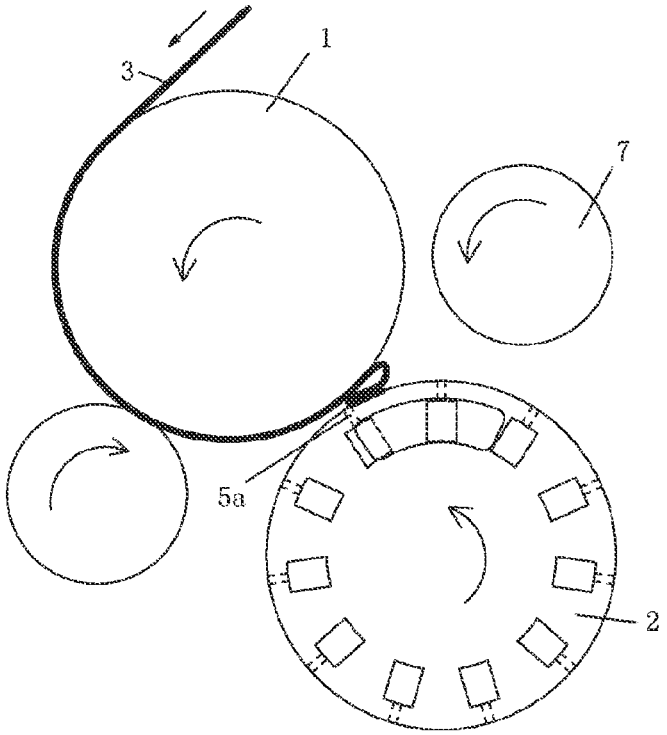
FIG. 7 illustrates a schematic diagram of the start of the winding process in the embodiment shown in FIG. 1.

The following describes the principle of starting the winding by referring to the embodiment shown in FIG. 1. As the rewinding lower roller 2 rotates, a row of air suction holes 5*a* on the surface of the roller body is interconnected with the exhaust opening of the air suction cover 6 to produce a suction force, so that the head portion of the paper 3 is attached to the rewinding lower roller 2. Then the rewinding lower roller 2 carries the head portion of the paper 3 backward to make the head portion of the paper rolled up to form the state as shown in FIG. 7. In the FIG. 7, the rolled up head portion of the paper is blocked by the roller gap between the rewinding upper roller 1 and the rewinding lower roller 2. In addition, the row of air suction holes 5*a* which interconnected with the air suction cover has rotated away from the roller gap gradually; the row of air suction holes 5*a* is disconnected with the air suction cover 6 and thus loses the suction force, which causes the rolled-up head portion of the paper to be blocked by the roller gap between the rewinding upper roller 1 and the rewinding lower roller 2. Then the subsequently fed paper can continue to be rolled with the rolled up paper, and thus the start of winding is performed.

After the start of winding, the diameter of the paper roll gradually increases. The rewinding upper roller 1, the rewinding lower roller 2 and the rider roller 7 together carry the paper roll to wind, until the rewinding is finished and the tail of the paper roll is pulled off, which forms a new paper head.

Figure 8:
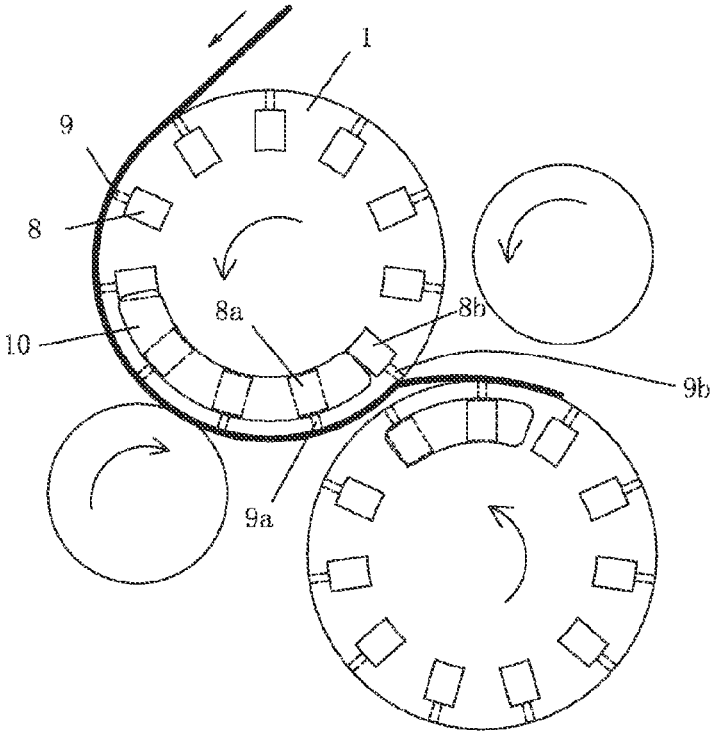
FIG. 8 illustrates a structure of the rewinding machine according to another embodiment of the present application.

As an improved embodiment of the present invention, a plurality of air flow channels 8 are arranged in the roller body of the rewinding upper roller 1 according to another embodiment shown in the FIG. 8. The plurality of air flow channels 8 are arranged spaced apart along circumference of the roller body, and every air flow channel 8 is interconnected with a set of air suction holes 9. A set of air suction holes 9, which is interconnected to the same air flow channel 8, is arranged into one or more rows on the surface of the roller body. Each row of air suction holes is arranged along the latitude direction of the roller body. Respective rows of air suction holes 9 are arranged spaced apart along the circumference of the roller body. The second air suction cover 10 is provided in a position close to an end of the rewinding upper roller. As the rewinding upper roller 1 rotates, when a certain row of air suction holes on the surface of the rewinding upper roller 1, such as a row of air suction holes 9*a* shown in FIG. 8, is gradually closing toward the roller gap between the rewinding upper roller 1 and the rewinding lower roller 2, the air flow channel 8*a* in the roller body, which is interconnected with the row of air suction holes 9*a*, is rotated to a region where it interconnects with the exhaust opening of the second air suction cover 10, which causes the whole row of air suction holes 9*a* to produce a suction force. When a certain row of air suction holes on the surface of the rewinding upper roller 1, such as a row of air suction holes 9*b* shown in FIG. 8, are gradually rotating away from the roller gap between the rewinding upper roller 1 and the rewinding lower roller 2, the air flow channel 8*b* in the roller body which is interconnected with the row of air suction holes 9*b*, is rotated to a region where it deviates from the exhaust opening of the air suction cover 10. In this way, each air flow channels 8 is periodically interconnected or disconnected with the exhaust opening of the second air suction cover 10 as the rewinding upper roller 1 rotates.

To summarize, the improvement shown in FIG. 8 is that the air flow channel 8, the air suction holes 9 and the second air suction cover 10, which are the similar type to the ones in the rewinding lower roller 2, are provided complementarily for the rewinding upper roller 1. Through the improvement, it can more reliably ensure that the rolled up head portion of the paper can be blocked by the gap between the rewinding upper roller 1 and the rewinding lower roller 2, and thus improve the reliability of the start of winding. The structures and operation principles of the air flow channels 8, air suction holes 9 and the second air suction cover 10 and the arrangement of the second air suction cover 10 can be referred to the one described in the prior embodiment; therefore, no further description is required.

The invention claimed is:

1. A coreless paper roll rewinding machine without a winding assisting plate, comprising a rewinding upper roller and a rewinding lower roller which are parallel to each other, a piece of paper having a predetermined thickness is wound on the rewinding upper roller and passes through a roller gap between the rewinding upper roller and the rewinding lower roller, the roller gap being located where the rewinding upper roller and the rewinding lower roller are closest to one another, the rewinding machine characterized in that the roller gap between the rewinding upper roller and the rewinding lower roller is no more than 10 mm and is greater than the thickness of the piece of paper;

a plurality of air flow channels are arranged in a roller body of the rewinding lower roller, the plurality of air flow channels are arranged spaced apart along a circumference of the lower roller body;

each air flow channel is interconnected with a set of air suction holes provided on a surface of the rewinding lower roller; the set of air suction holes, which is interconnected with the same air flow channel, is arranged in one or more rows on a surface of the lower roller body;

each row of air suction holes is arranged along air flow channels in the lower roller body;

respective rows of air suction holes are arranged spaced apart along the circumference of the lower roller body;

an air suction cover is arranged in a position close to the end of the rewinding lower roller;

as the rewinding lower roller rotates, when a certain row of the air suction holes on the surface of the rewinding lower roller is gradually closing toward the roller gap between the rewinding upper roller and the rewinding lower roller, the air flow channel in the lower roller body, which is interconnected with the row of air suction holes, is rotated to a region where it interconnects with an exhaust opening of the air suction cover; when a certain row of the air suction holes on the surface of the rewinding lower roller are gradually rotating away from the roller gap between the rewinding upper roller and the rewinding lower roller, the air flow channel in the lower roller body, which is interconnected with the row of air suction holes, is rotated to a region where it deviates from the exhaust opening of the air suction cover.

2. A coreless paper roll rewinding machine without a winding assisting plate according to claim 1, characterized in that a plurality of air flow channels are arranged in a roller body of the rewinding upper roller, the plurality of air flow channels are arranged spaced apart along a circumference of the upper roller body;

each air flow channel is intercommunicated with a set of air suction holes on a surface of the upper roller body provided on the surface of the rewinding upper roller; a set of air suction holes, which is interconnected with a same air flow channel, is arranged in one or more rows on a surface of the upper roller body;

each row of air suction holes is arranged along an air flow channel of the upper roller body;

respective rows of air suction holes are arranged spaced apart along the circumference of the upper roller body;

a second air suction cover is arranged in a position close to the end of the rewinding upper roller;

as the rewinding upper roller rotates, when a certain row of the air suction holes on the surface of the rewinding upper roller is gradually closing toward the roller gap between the rewinding upper roller and the rewinding lower roller, the air flow channel in the upper roller body, which is interconnected with the row of air suction holes, is rotated to a region where it interconnects with an exhaust opening of the second air suction cover; when a certain row of the air suction holes, on the surface of the rewinding upper roller are gradually rotating away from the roller gap between the rewinding upper roller and the rewinding lower roller, the air flow channel in the upper roller body, which is interconnected with the row of air suction holes is rotated to a region where it deviates from the exhaust opening of the second air suction cover.

* * * * *